United States Patent [19]

Lyu

[11] 4,442,692

[45] Apr. 17, 1984

[54] TANDEM IRONING LAND ASSEMBLY

[75] Inventor: Seung W. Lyu, Palos Hills, Ill.

[73] Assignee: National Can Corporation, Chicago, Ill.

[21] Appl. No.: 323,747

[22] Filed: Nov. 23, 1981

[51] Int. Cl.[3] ..... B21D 22/00

[52] U.S. Cl. ..... 72/349; 72/468

[58] Field of Search ..... 72/347, 348, 349, 468

[56] References Cited

U.S. PATENT DOCUMENTS 2,373,600 4/1945 Slater ..... 72/349

3,360,157 12/1967 Bolt et al. ..... 72/349

3,951,296 4/1976 Swanson et al. ..... 72/349 X 4,217,770 8/1980 Wasser ..... 72/349

*Primary Examiner*—Leon Gilden

*Attorney, Agent, or Firm*—Robert A. Stenzel; Ralph R. Rath

[57] ABSTRACT

A drawing and ironing assembly including a punch movable along a path having a plurality of spaced ironing die assemblies with the last of the ironing die assemblies having twin spaced lands, the diameter of the second twin land is slightly greater than the diameter of the first land to produce a very small amount of ironing.

9 Claims, 8 Drawing Figures

TANDEM IRONING LAND ASSEMBLY

DESCRIPTION

Technical Field

The present invention relates generally to drawing and ironing of containers and, more particularly, to an improved ironing ring assembly for use in producing drawn and ironed containers.

Background of Prior Art

In the formation of "two-piece" containers, it is customary to utilize a plurality of die assemblies that cooperate with a punch for converting circular metal discs into finished containers. Conventional equipment utilized for producing such containers includes a cupping machine which cuts a circular metal disc from a blank sheet of material and converts the disc into a cup which is then transferred to a bodymaker wherein the cup is converted into the finished container.

One type of bodymaker that is presently being utilized is manufactured by Ragsdale Brothers, Inc., which includes a cup redraw assembly, a plurality of ironing assemblies and a stripper assembly arranged in series along a path for a punch. The original cups have a diameter larger than the finished internal diameter of the container and are initially redrawn by the redraw assembly and the sidewall thereof is then reduced in thickness between the punch and the plurality of ironing die assemblies. At the end of the stroke for the punch, the end wall of the container is generally reformed to a dome-shaped configuration and the container is removed or "stripped" from the punch on the return stroke of the punch by the stripper assembly.

Recent technology advances in can making machines has resulted in production of drawn and ironed containers at a rate of more than 200 containers per minute utilizing bodymakers such as manufactured by Standun, Inc. Recent technology has also resulted in sidewall reductions of more than 70% from the original cup sidewall thickness which results in considerable heat being developed during such reduction, along with residual stresses or hoop-stresses being developed in the container during the ironing process. Such internal stresses, requiring higher stripping force which requires that the bodymaker incorporate what is termed as a "positive knockout". The "positive knockout" is an element that is incorporated into the end portion of the punch and is moved relative to the remainder of the punch to initiate movement of the finished container from the punch.

It has been known that reduction of residual stresses in the drawn and ironed container will reduce the stripping forces necessary for removing the container from the punch after the ironing operation is completed. One method of reducing residual stresses is suggested in U.S. Pat. No. 3,972,217, wherein the drawing and ironing operation incorporates an additional die which produces a small reduction at the end of the ironing operation to reduce the stripping force required for removing the container from the punch. In the examples set forth in this patent, it is suggested that the minimum stripping force can be achieved by having a reduction of approximately 8.5% in the last ironing die.

Problems relating to residual stresses have been in existence for decades, and are particularly noted in the field of thick wall tube drawing. While tube drawing is not relevant to the present invention, an in-depth analysis of this field is presented in a thesis by Surya Kumar Misra in January, 1968 entitled "In-Process Control of Residual Stresses In Drawn Tubing", incorporated herein by reference, on file with the Illinois Institute of Technology, Metalurgical Department and Crerar Library in Chicago, Ill. A summary of this thesis is presented in a paper bearing the same title, published in the December, 1968 issue of the American Society of Mechanical Engineers.

Providing guide surfaces in tube drawing is also disclosed in U.S. Pat. No. 2,373,606, which contemplates utilizing identical diameter ironing dies to guide the short side of an uneven free edge of a tube in the lower die while the long side of the tube is being formed by the upper die, but the provision of guide surfaces is not analagous to ironing of thin-walled containers.

In the drawing and ironing operation, it has also been suggested to utilize slightly larger diameter guide surfaces adjacent the last ironing die to guide the finished container as it is exiting from the ironing die. U.S. Pat. No. 4,254,652 discloses such a guide arrangement associated with a drawing and ironing assembly.

Multiple land ironing dies of identical diameters have also been proposed in drawing and ironing of containers as evidenced by U.S. Pat. Nos. RE 23,095 and 4,026,140.

Summary of the Invention

According to the present invention, it has now been determined that utilizing an additional die closely adjacent to the last ironing die in a drawing and ironing operation of thin-walled containers with the additional ironing die having a diameter slightly larger than the diameter of the last ironing die will result in a very small reduction in wall thickness or ironing and will significantly decrease the stripping forces required for stripping the finished container from the punch of the drawing and ironing machine.

More specifically, in making standard beverage containers, the second of the twin lands of an ironing ring assembly has a diameter that is in the range of about 1.00003 to about 1.00030 times greater than the diameter of the adjacent ironing land to produce a sidewall reduction about 0.1 to about 1 percent. It has been determined that this arrangement maximizes the stress relief of the residual circumferential or hoop-stresses in the container body to minimize the amount of force required for removing the container from the punch after the ironing operation is completed.

It has also been determined that the slight reduction of about 1 percent in the last ironing land results in a container, for example, having far superior outer surface characteristics than containers formed from conventional drawing and ironing dies. Actual tests have shown that the outer surface of the sidewall of the drawn and ironed container has a surface roughness finish of less than 2 microinches. Stated another way, the container surface reflectance was significantly increased utilizing the double land discussed above resulting in a reflectance in the range of about 90%.

BRIEF DESCRIPTION OF SEVERAL VIEWS OF DRAWINGS

FIG. 1 of the drawings discloses a drawing and ironing portion of a conventional bodymaker having the present invention incorporated therein;

DETAILED DESCRIPTION

Figure 1:
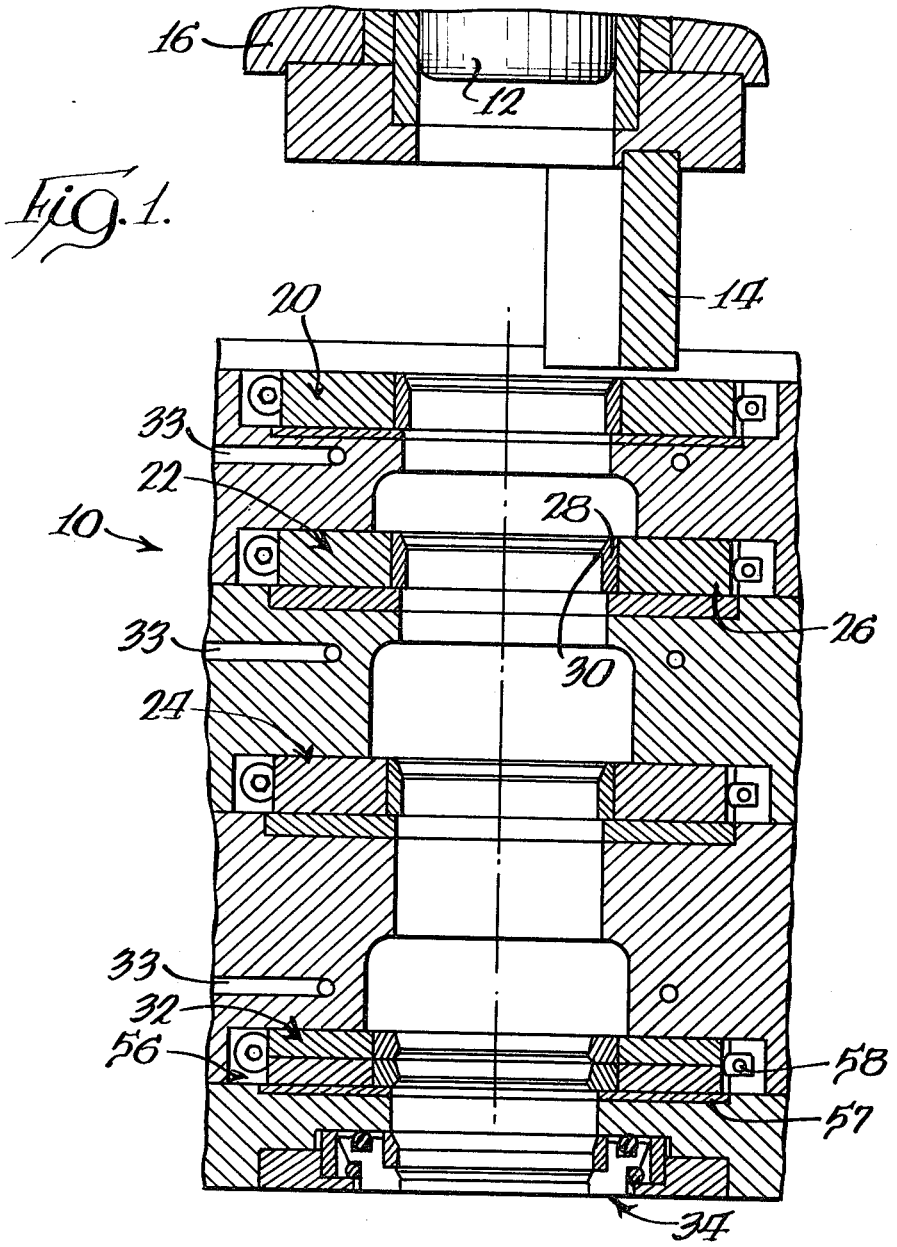

While this invention is susceptible of embodiment shown in many different forms, there is shown in the drawings and will herein be described in detail preferred embodiments of the invention with the understanding that the present disclosure is to be considered as exemplification of the principles of the invention and is not intended to limit the broad aspect of the invention to the embodiments illustrated.

FIG. 1 of the drawings discloses a toolpack generally designated by reference numeral 10 that cooperates with a punch 12 for converting a cup into a drawn and ironed container, as is well known in the art. A cup (not shown) is moved into the path of the movable punch and is accurately positioned by a positioning member 14 to be picked up by the punch, which is guided for movement by a support member 16, and moved through the toolpack.

The toolpack includes a redrawn assembly 20 first and second ironing die assemblies 22 and 24 of substantially identical construction. Each ironing die assembly includes a die-support member 26 supporting an ironing die 28 having an ironing land 30 which cooperates with punch 12 to reduce the thickness of the sidewall of the cup as it is passing through the toolpack 10. The respective ironing die assemblies have progressively decreasing diameter ironing lands 30. The third ironing die assembly 32, illustrated in FIG. 1, is constructed in accordance with the present invention, as will be explained below. Cooling fluid having a lubricant therein is supplied to the ironing dies through chamber 33, as is well known in the art.

After the cup passes through the assemblies 20, 22, 24 and 32, it moves through a stripper assembly 34. At the end of the stroke for the punch 12, the end of the punch cooperates with a domer assembly (not shown) to reform the end wall of the drawn and ironed container.

Normally, commercial drawing and ironing results in a significant sidewall reduction of the cup during the ironing operation to produce the finished container. Usually this reduction is on the order of at least 70%, which results in significant build-up of heat within the wall of the container which may reach a temperature as high as 400° F. when producing containers at a rate of more than 200 per minute. During such significant reduction, there is considerable relative movement of the various particles of the sidewall thickness between the inner surface, which is essentially unchanged except for increase in height when compared to the outer surface that is being, in effect, pushed upwardly and inwardly. This results in different elasticity of the various elements that form the sidewall. Of course, the die elements which are also utilized for the actual ironing operation have certain inherent thermal expansion during the ironing process and will be compressed during the ironing operation and then will expand slightly immediately after the ironing operation. It is also known that immediately after the portion of the container body has passed through or across the ironing land, there is a certain amount of instant spring-back of the metal. The entire ironing process develops significant residual stresses within the metal which, in turn, effects the stripping forces necessary for removing the container from the punch, particularly after the temperature has dropped significantly from the 400° F. range, resulting in a shrinking of the container on the punch.

It has now been determined that the stripping forces can be reduced significantly by utilizing what may be termed a "spaced twin land concept" as the last ironing die assembly.

Figure 2:
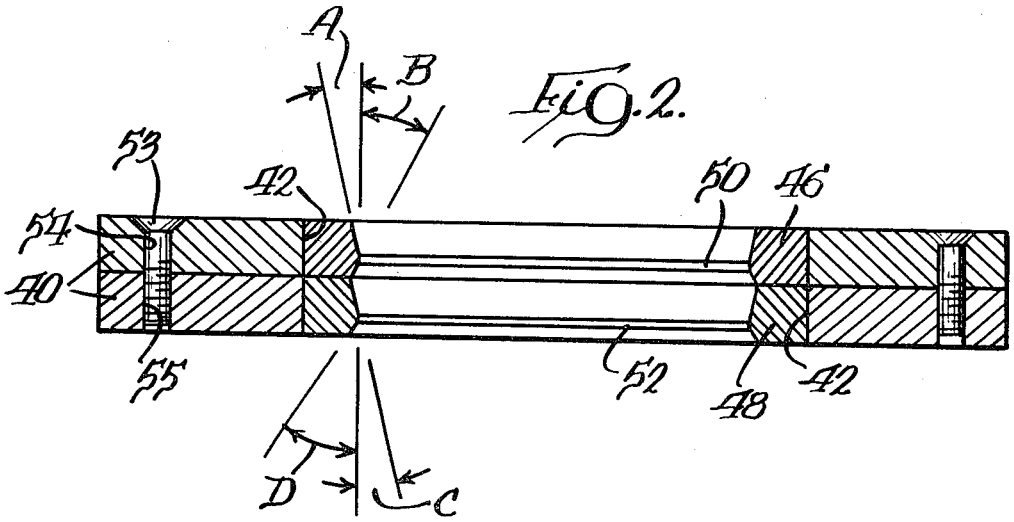
FIG. 2 is an enlarged cross-sectional view of the ironing die assembly of the present invention.

As illustrated in FIG. 2, the ironing die assembly 32 consists of a pair of substantially identical holders 40 which have generally circular openings 42 therein. A first or upper die element 46 is received into opening 42 of upper holder 40, while a second die element 48 is located in opening 42 of the lower holder 40. The upper die element 46 has a narrow circular ironing land 50, while the lower element 48 has a narrow circular ironing land 52.

Holders 40 are held by screws 53 received through openings 54 in upper holder 40 into threaded openings 55 in lower holder 40. Holders 40 are received into a space 56 and supported for radial movement on a plate 57. Holders 40 are biased to a centered position by a biasing mechanism 58. It should be noted that the axial dimension of holders 40 is about one-half of the axial dimension of holders 26 so that both holders 40 fit into the same space as a single holder 26. Thus, in this embodiment, the spacing between lands 50 and 52 is approximately one-half inch.

The respective die elements 46 and 48 are preferably formed from carbide and the upper die elements 46 has a small entrance angle A defined thereon between the upper surface of the die element and the upper edge of the land 50 which is preferably on the order of about 10°. Also, the trailing portion of the ironing die element between land 40 and the lower surface has a small exit angle B which is preferably slightly greater than angle A and is also preferably less than 15°. The lower die assembly 48, likewise, has a small entrance angle C and an exit angle D. Lands 50 and 52 also have an axial length L, which will be discussed later.

According to the primary aspect of the present invention, the diameter of land 52 is made only slightly larger than the diameter of land 50 in the last ironing assembly 32, resulting in a signficant reduction in wall thickness during the cooperation between ironing land 50 and the punch 12 with only a slight reduction in wall thickness on the order of less than 1 percent by the cooperation in diameter of ironing land 52 with punch 12. This increase in diameter of ironing land 52 over ironing land 50 is on the order of 1.00003 to about 1.00030 times, and preferably is in the range of about 1.00015 times greater.

It was also determined that the spacing between the ironing lands had some effect in producing optimum results. While the spacing parameters have not been fully explored, it is believed that the spacing between the two ironing lands is preferably on the order of 1 inch or less which produced significant decreases in stripping forces.

Experiments were conducted utilizing conventional standard tooling for producing 16-ounce drawn and ironed steel cans having a size which is conventionally referred to as "211/209×609". Conventional steel having a tin layer on one surface (outer surface) of 0.30 lbs./bb and a tin layer on the other surface (inner surface) of 0.20 lbs./bb was converted to control cups utilizing the conventional cupping machinery. The initial drawn control cups were drawn and ironed with a commercial bodymaker using positive knock-out elements while coolant flowing through the toolpack was maintained at a temperature of about 88° F. A second set of control cups were drawn and ironed into finished containers under identical circumstances and the temperture of the coolant was maintained at approximately 122° F. The last ironing ring assembly was then removed and replaced with an ironing ring assembly having a first standard ironing ring having a diameter of 2.6025 and a second standard ring directly adjacent the first one having a diameter of 2.6029 inches used in conjunction with a punch which had a diameter of 2.5952 inches. In a third experiment, the spacing between the two ironing lands was 1 inch and conventional cups were drawn and ironed to produce finished containers while the coolant was maintained at a temperture of about 120° F. The results were that the stripping loads were decreased by about 59% when compared with the finished containers that were drawn and ironed while the coolant temperature was maintained at about 88° F. When compared to containers that were drawn and ironed while maintaining the temperature of the coolant at about 120° F., a 36% reduction in stripping forces was noted.

Further experiments were then conducted to determine the optimum increase in the diameter of the two ironing lands in the last ironing assembly.

In this experiment, the steel utilized had a thickness 0.0123 inches, a yield strength of 50.5 KSI, a tensile strength of 57.2 with an elongation rate of 25% and a Rockwell hardness of 56.1. The standard toolpack consisted of a punch having a diameter of 2.5948 inches, a redraw ring having a diameter of 2.6182 inches, a first ironing ring having a diameter of 2.6130 inches, a second ironing ring having a diameter of 2.6074 inches and a third ironing ring having a diameter of 2.6022 inches.

The metal was converted into cups in a conventional cupper using a lubricant coolant of water and 10% Quakerol No. 558 lubricant. The cups were converted into finished drawn and ironed containers using a conventional bodymaker with a lubricant-coolant consisting of water with 4% Quakerol No. 504 lubricant that was maintained at about 120° F.

Figure 7:
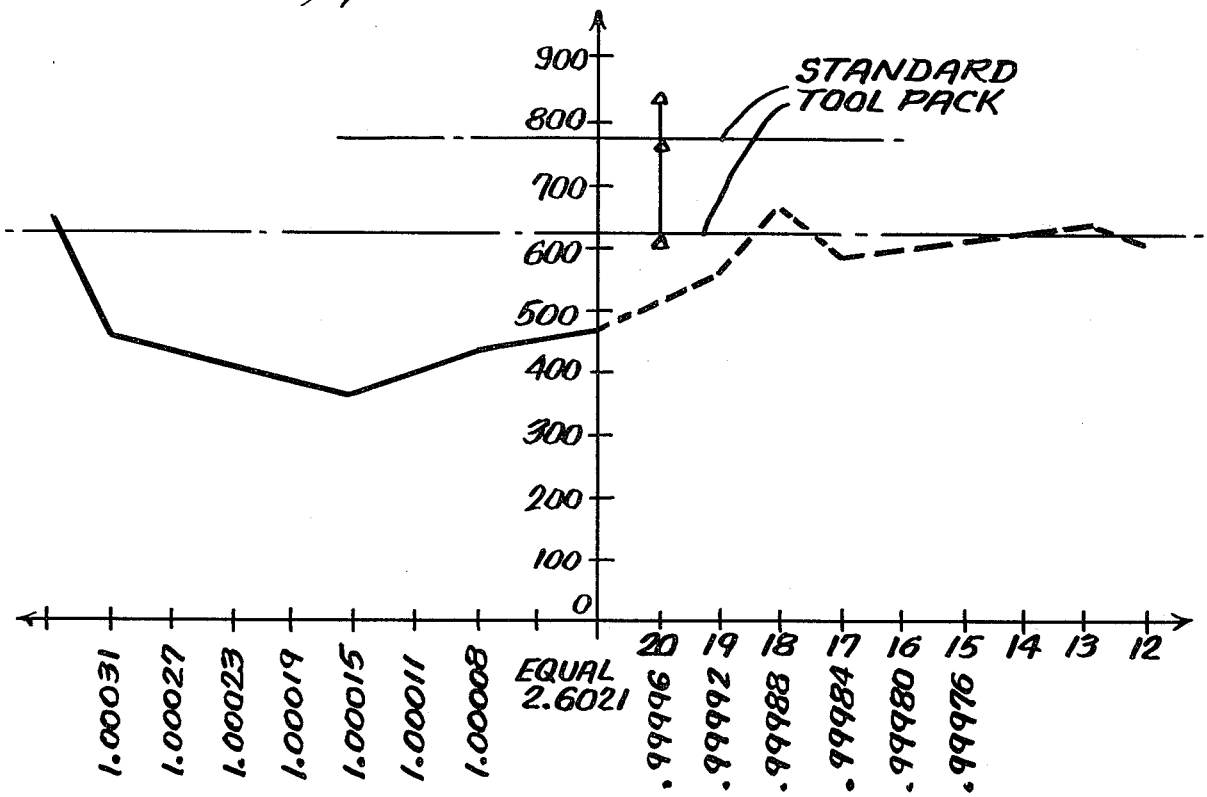
FIG. 7 is a graph representing stripping forces in relation to relative diameters between the lands of the ironing die assembly shown in FIGS. 2–6; and, FIG. 8 is a further graph representing stripping forces similar to the graph illustrated in FIG. 7.

The results of these tests are shown in the graph illustrated in FIG. 7. The graph illustrated in FIG. 7 plots stripping forces along the ordinate in relation to diameter ration between the two lands along the abscissa. Utilizing an average of the two experiments conducted with standard toolpacks in the fourth ironing ring, an average stripping force of about 700 pounds was experienced. The middle of the graph, illustrated in FIG. 7, shows the stripping forces encountered when utilizing twin lands of an equal diameter of 2.6021 and having a spacing of approximately 1 inch with the ironing lands having an axial dimension (L) of about 0.030 inches. It will also be noted that as the diameter of the lower land of the twin lands was increased beyond the diameter of the upper land, the stripping forces were reduced significantly to a point where the difference is approximately 1.00015 times greater than the diameter of the upper ironing land where the stripping forces were at a minimum of approximately 350 pounds.

Additional tests were conducted using different metals and lubricants. A steel sheet having a thickness of 0.0125 inches and tin coatings of 0.020 and 0.30 lbs/bb on the ultimate outer and inner surfaces of the sheet was selected. The steel had a yield strength of 31.2 KSI, a tensile strength of 44.5 KSI, a percentage elongation of 32.5 and a Rockwell hardness of about 50. Control drawn cups were drawn and ironed using a standard toolpack in a conventional bodymaker having a punch diameter of 2.5970 inches, a redraw ring land diameter of 2.6223 inches and first, second and third ironing rings respectively having diameters of 2.6140, 2.6087, and 2.6042 inches. The control cups were formed on a conventional cupping machine using a lubricant-coolant of water and 15% Quakerol No. 559 lubricant. The cups were then drawn and ironed in a conventional bodymaker using a lubricant-coolant of water having 4% Quakerol No. 504 lubricant maintained at a temperature of about 110–115° F. The positive knock-out was inactivated and air pressure of 40–45 psi was used to aid in stripping the finished container from the punch. The stripping forces necessary to remove the containers from the punch are shown along the ordinate in the graph illustrated in FIG. 8 and ranged between 310 and 350 pounds.

The third ironing ring was then removed and replaced with twin ironing rings with the third ring having a diameter of 2.6040 inches and the fourth ring having a diameter of 2.6044 inches. The ironing lands had a width of about 0.030 inches and the third and fourth lands had a spacing of about one-half inch. Additional drawn and ironed containers were formed with the same parameters described above. In one experiment, the fourth ring was fixed while in the other experiment the fourth ring was floating.

Figure 8:
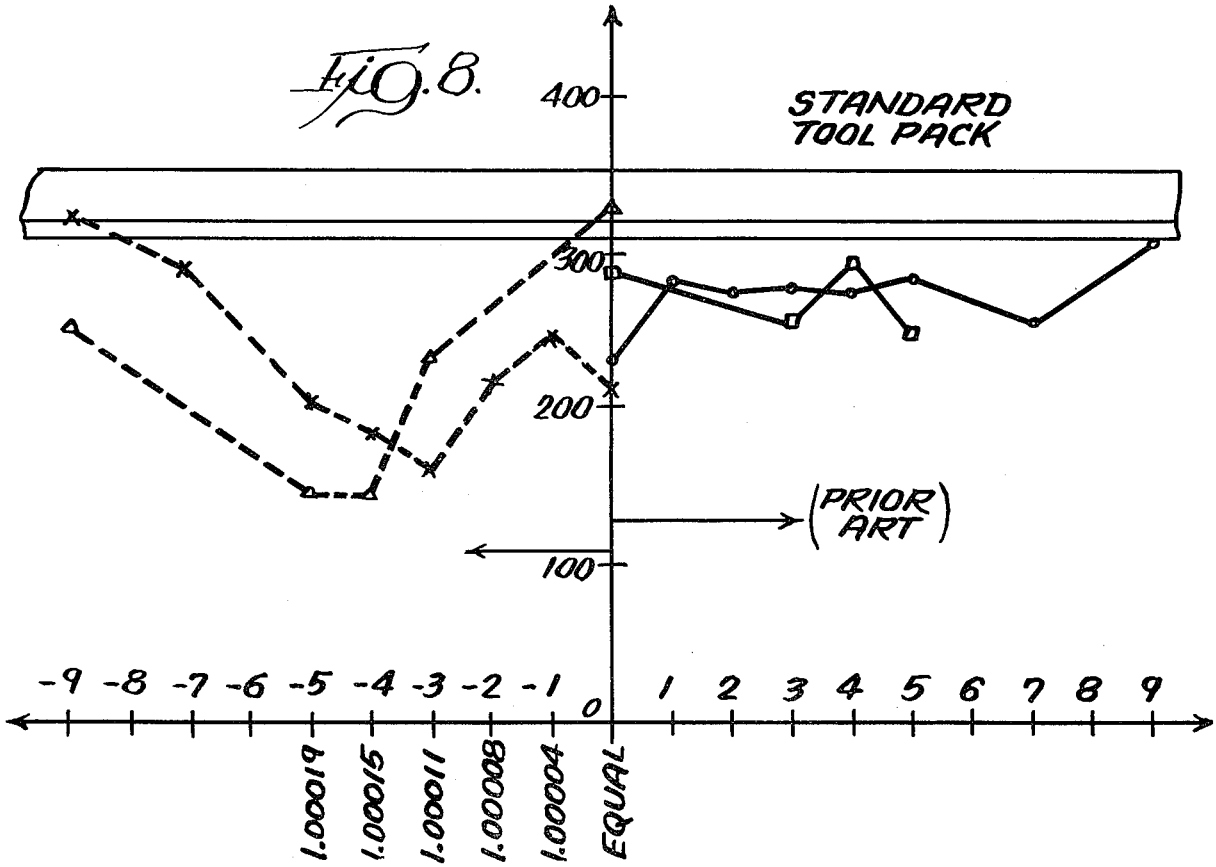

The diameter of the fourth ironing ring was then varied while the diameter of the third ironing ring was maintained constant and containers were drawn and stripping forces were measured and plotted on the graph illustrated in FIG. 8. Line 59 represents these measurements using a fixed fourth ironing ring and line 61 represents these measurements using a floating fourth ironing ring.

Further tests were conducted utilizing a different size can (211×409) which translates to a 12-ounce beer and beverage can. The standard toolpack utilized for producing the control measurements included a punch having a diameter of 2.5948 inches, a redraw ring having a diameter of 2.6160 inches, a first ironing land having a diameter of 2.6130 inches, and a second ironing land having a diameter of 2.6064 inches, and a third ironing assembly having a diameter of 2.6022 inches. Drawn and ironed containers utilizing this standard toolpack were produced and the temperature of the coolant was maintained in the range of about 110°–120° F. Two different tinplate-coated steel metals were utilized and the respective metals exhibited "rollback condition" in a number of containers during the stripping operation. A "rollback condition" is one where the upper free edge of the container tends to roll over during the stripping operation. The average stripping force required utilizing a domestic standard steel sheet having 20 and 30 lbs/bb of layers on respective surfaces showed a stripping force of approximately 358 pounds.

Utilizing the same set-up and replacing the third ironing ring assembly with the twin land concept of the present invention, the stripping forces were reduced to 232 pounds which again translates to a reduction in stripping force of more than 35%. Conducting the same experiment with a different metal having the same tin coatings, the average stripping force required with a conventional third ironing ring assembly was 472 pounds and with the twin land concept was reduced to 223 pounds.

With these favorable results, further experimental trial production runs were made on several commercial assembly lines utilizing the same type of tooling and it was determined that the laboratory experimental results were confirmed. The experimental production trial runs also prove that additional side benefits were derived from utilizing the tandem ironing arrangement, as discussed above. For example, the use of the twin lands in the last ironing die assembly eliminated the necessity for the positive knock-out arrangement heretofore necessary in some of the drawing and ironing operations, particularly when producing steel containers. It was also determined that less tin was required on the steel surfaces, thereby reducing the overall cost of manufacturing containers. It was determined that the outer coating of tin could be reduced to less than 0.20 lbs/bb and still produce satisfactory containers. The resultant containers were more uniform in wall thickness with longer tool life of the same tooling in the same bodymaker. The tolerance in wall thickness was reduced by 50%.

Tests were also conducted with respect to surface finish and shininess of the drawn and ironed steel containers produced in the experimental trial production runs.

Containers produced, using standard commercial tooling, were tested on a "Federal" surf-analyzer and the roughness surface finished ranged between an arithmetic average of two and six microinches. The containers produced in accordance with the present invention had a roughness surface finish of an arthmetic average in the range of one to one and one-half microinches with the majority of the containers tested having a roughness surface finish of one microinch.

The shininess of the containers was also analyzed using an Infra-red Spectroscope. A standard containers made on a commercial bodymaker produced reflectance measurements of about 68% while a container produced on the same bodymaker using the twin land concept of the present invention produced reflectance measurements of about 90%.

The superior surface finish not only adds to the appearance, when compared to standard containers, but additional benefits are derived which will further reduce the overall cost of the container. Heretofore, the appearance of the outer surface of the container made it necessary to place a base coating on the container before the customary label was applied to the container. With the container produced with the tooling of the present invention, the base coating can be eliminated for many labels, producing an additional savings.

As indicated above, the spacing between the ironing lands has some effect on the quality of the finished container, but the optimum spacing has not yet been determined. Some of the tests were conducted where the twin lands were spaced apart by a dimension of one-half inches and the tests compared favorably with tests that were conducted where the spacing was one inch. The criticality of the spacing is believed to relate to the "spring back" of the metal as it exits from an ironing land. It is believed that the sidewall of the container, at least the outer surface, is bowed outwardly to some extent and must still be in that condition when it reaches the second of the twin ironing lands to produce ironing of the sidewall with the larger diameter ironing land.

It will be appreciated that in the drawing and ironing operation, the common thought heretofore was that each subsequent ironing ring must be progressively smaller than the previous ironing in order to get any ironing or sidewall reduction.

FIGS. 3–6 of the drawings illustrate various different assemblies which may be used to hold the twin ironing rings.

Figure 3:
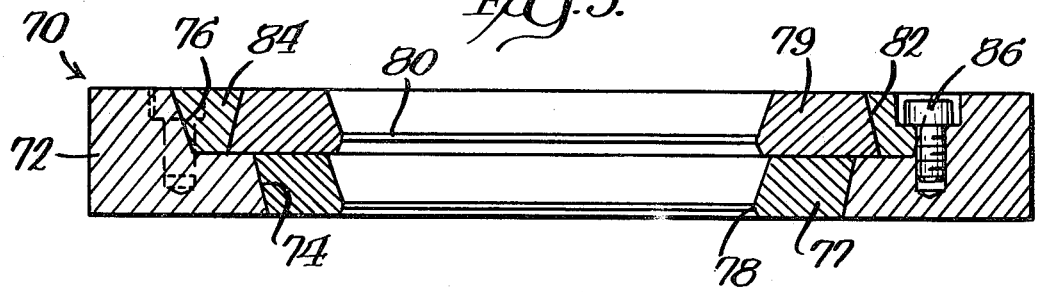
FIG. 3 is a view similar to FIG. 2 showing a modified form of ironing die assembly.

Referring to FIG. 3 of the drawings, ironing die assembly 70 consists of a holder or ironing die support 72 having a tapered opening 74 adjacent the lower surface and an enlarged tapered opening 76 at the adjacent upper surface. A lower ironing die 77 having an ironing land 78 is supported in tapered opening 74 while an upper ironing 79 having a land 80 is received into the center of the enlarged portion 76. The upper ironing die 79 has a tapered outer wall 82 and both ironing dies 77 and 79 are held within the respective openings by a tapered sleeve 84. Sleeve 84 is retained in position by a plurality of screws 86 that are received into threaded openings 88 in the holder 72. The relationship of the diameter of the ironing lands 78 and 80 is the same as that discussed in connection with the ironing lands 50 and 52.

Figure 4:
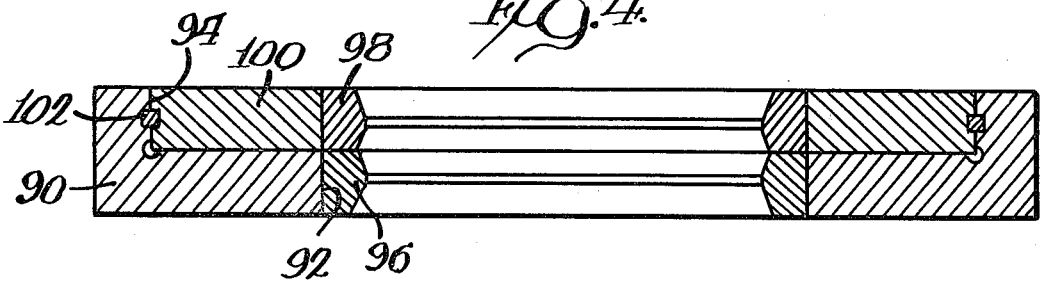
FIG. 4 is a further modified form of the invention illustrated in FIG. 2.

The further modified form of assembly is illustrated in FIG. 4 and includes a holder or ironing die support 90 having a reduced opening 92 and enlarged opening 94. A lower ironing die 96 is supported within opening 92 while an upper ironing die 98 is supported in a holder 100 which is received into the enlarged portion 94. A resilient centering member 102 may be interposed between holders 100 and 90 to act as a centering means for the upper ironing ring 98 while the lower ironing die remains fixed.

Figure 5:
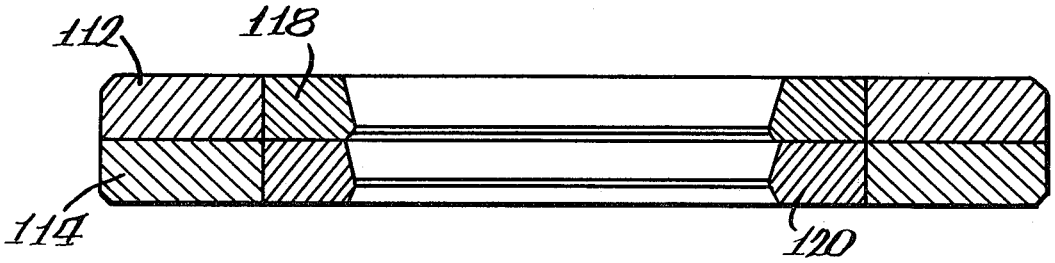
FIG. 5 is a further modified form of the invention illustrated in FIG. 2.

The embodiment illustrated in FIG. 5 is similar to the embodiment illustrated in FIG. 2 and includes an upper holder 112 and a lower holder 114. The upper holder 112 supports upper ironing ring 118 while the lower holder 114 supports ironing ring 120. Again, the relationship of the land on the respective ironing rings is as described above. In this embodiment, the respective ironing ring assemblies can move radially with respect to each other.

In all of the embodiments described above, the ironing dies and holders are dimensional to fit into the space provided for a conventional third ironing ring assembly, that is to say that the axial dimensions of the ironing rings are about one-half the axial dimension of a conventional ironing die assembly. Also, the ironing lands are positioned on the ironing ring so that there is an axial spacing of about one-half inch between lands.

Figure 6:
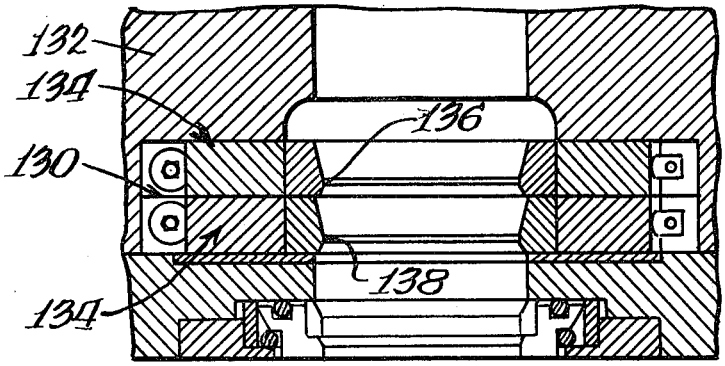
FIG. 6 is a fragmentary cross-section similar to FIG. 1 showing a further modified form of ironing die assembly.

In the embodiment illustrated in FIG. 6, the toolpack is modified so that the area where the third ironing assembly is normally located can receive two conventional ironing assemblies. In this embodiment, a space 130 is created in the toolpack frame 132 to receive two standard ironing die assemblies 134 which are identical except for the diameter of lands 136 and 138. The respective ironing die assemblies 134 are individually biased to centered position by respective biasing means 140. Utilizing two standard ironing die assemblies will result in having a space of about one inch between lands 136 and 138.

What is claimed is:

1. An ironing assembly for use with a punch to iron a sidewall of a thin-walled container having an integral end wall comprising a pair of spaced ironing lands with the first of said ironing lands having a diameter to produce a sidewall reduction of at least thirty-five percent and said second ironing land having a diameter in the range of about 1.00003 to about 1.0003 times greater than the diameter of said first ironing land to produce a sidewall reduction in the range of about 0.1 to about 1 percent.

2. An ironing die assembly as defined in claim 1, in which said sidewall reduction by said second ironing land is less than about 0.5 percent.

3. In a drawing and ironing assembly having a punch movable along a path with a plurality of ironing ring assemblies along said path cooperating with said punch to reduce the sidewall thickness of a container, the improvement of the last of said ironing ring assemblies along said path including a pair of spaced ironing lands with the first of said pair of ironing lands producing a significant amount of sidewall reduction and the other of ironing lands producing a sidewall reduction of less than one percent to produce a surface finish on an outer surface of said sidewall of less than 2 microinches.

4. In a drawing and ironing assembly for producing a container including a punch movable along a path having a plurality of spaced ironing die assemblies, the improvement of the last of said ironing die assemblies including axially spaced first and second lands, said second land having a diameter in the range of about 1.00003 to about 1.0003 times greater than the diameter of said first ironing land, said lands having an axial spacing of no more than one inch resulting in a sidewall reduction in the range of about 0.1 to about one percent with said second land to reduce internal stresses in said sidewall, thereby reducing the forces required to remove the finished container from the punch.

5. A drawing and ironing assembly as defined in claim 4 in which said second land has a diameter of about 1.00015 times greater than said first land.

6. An ironing die assembly comprising ironing die support, first and second ironing dies carried by said support and each having an ironing land thereon, said ironing lands having a diameter ratio in the range of about 1.00003 to about 1.0003 and having a spacing of no more than one inch.

7. An ironing die assembly as defined in claim 6 in which said ironing die support has a first enlarged tapered opening extending from one surface and a second reduced tapered opening extending from an opposite surface, said second ironing die having a tapered peripheral surface receiving into engagement with said second reduced tapered opening and said first ironing die having a reverse taper with respect to said enlarged tapered opening and said first ironing die retaining both of said ironing dies in said ironing die support.

8. An ironing die assembly as defined in claim 6 in which said ironing die support includes two substantially identical holders with said ironing dies fixed in said holders.

9. An ironing die assembly as defined in claim 6 in which said ironing die support has an enlarged circular opening extending from one surface and a reduced circular opening extending from an opposite surface with said second ironing die received into said reduced circular opening, and a holder supporting said first ironing ring and received into said enlarged circular opening.

* * * * *